United States Patent [19]

Slemmons

[11] 4,309,017

[45] Jan. 5, 1982

[54] REVERSABLE TWO-POSITION FRAME HANGER

[76] Inventor: John W. Slemmons, 19142 Glen Albyn La., Orange, Calif. 92669

[21] Appl. No.: 72,480

[22] Filed: Sep. 4, 1979

[51] Int. Cl.[3] ..... A47G 1/24

[52] U.S. Cl. ..... 248/495; 248/497

[58] Field of Search ..... 248/489, 495, 494, 496, 248/497, 498, 467, 477, 476

[56] References Cited

U.S. PATENT DOCUMENTS

| | | | |
|---|---|---|---|
| 1,410,765 | 3/1922 | Leas | 248/494 |
| 2,492,411 | 12/1949 | Barnes et al. | 248/494 X |
| 2,879,018 | 3/1959 | Pence | 248/477 X |
| 3,384,987 | 5/1968 | Prechtl | 248/489 X |
| 3,604,673 | 9/1971 | Klein | 248/467 |
| 3,784,150 | 1/1974 | Kulicke | 248/467 X |
| 3,876,175 | 4/1975 | Roberts | 248/476 X |

FOREIGN PATENT DOCUMENTS

| | | | |
|---|---|---|---|
| 90345 | 9/1957 | Norway | 248/495 |

*Primary Examiner*—J. Franklin Foss

[57] ABSTRACT

A planar, three-member, reversable two-position frame hanger capable of coupling to and holding an art frame in a first flat configuration against a wall or in a second stand-off position away from the wall is presented. The hanger includes a first support member having a base which is coupled to the frame slightly above the center of gravity of the frame. The base is axially symmetrical and has coupled thereto side members of the width that the frame is to stand-off from the wall. A top member coupled to the base locks the two side members into stand off position. For large frames, two lower members, each comprising a base with side members coupled thereto along a fold line, maintain the frame parallel to the wall. The two side members of the bottom members coupled together provide spacing in the stand-off position.

3 Claims, 8 Drawing Figures

REVERSABLE TWO-POSITION FRAME HANGER

BACKGROUND OF THE INVENTION

1. Field of the Invention

The present invention relates to simple reversible two-position frame hangers.

2. Description of the Prior Art

Different people are pleased by different arrangements. In recent years, a substantial number of people have discovered that they enjoy looking at art and photographs when the art of photographs are in a stand-off position about an inch from the wall. Initially, wood and other similar type of material was used to make the frame stand-off from the wall. In recent years, a variety of support means have been used which permit these frames to stand-off from the wall.

Unfortunately, art being as subjective as it is, some people enjoy seeing an art frame in the stand-off position for a while and then want it switched back to the flush position against the wall. Unfortunately, up to the time of the present invention, this has required a substantial amount of work. There has been, prior to the present invention, no simple frame hanger which is reversable and quickly and easily permits the art lover to switch his art back and forth from the flush to the stand-off position. There has been no prior art including the advantages of the present invention which can be shipped flat or stored flat prior to and after use. Most prior mechanisms are expensive, heavy not designed to make maximum use of the laws of mechanics, not designed to compensate for structural change in art after hanging, and do not have the two position feature and flexibility of the present invention.

SUMMARY OF THE INVENTION

A planar at least one member reversible two-dash position support and spacing means, hereafter referred to as support means is presented. The support means is capable of coupling to and holding an art frame in a first flat configuration substantially against the wall and in a second stand off position a selected distance away from the wall. The support means comprises a first support and spacing member hereafter referred to as the support member, and for large frames, at least two additional, spacing members.

The support member comprises a planar base having coupled thereto along fold lines 2 planar side flaps and a planar top member.

The base has coupled thereto on each the left and right side along fold lines generally parallel to the axis of the axially symmetrical base the two generally rectangular, planar side flaps about the width that the frame is to stand off from the wall. Each side flap includes a top surface above the top of the base defining a slot which when the side flap is perpendicular to the base, is generally aligned along the plane passing near the center of gravity of the frame.

The planar top member is coupled to the top surface of the base along the fold line perpendicular to the axis. The planar top member has a locking tab on each side capable of removably mating with the slot in the side flaps when the side flaps are folded approximately perpendicular to the base. The plane of the top member passes near the center of gravity of the frame when the tabs are mated to the slot. The top surface of the planar top member defines a receptacle capable of mating with hanging means coupled to a wall.

Each of the spacing/members comprises a planar generally square base coupled along parallel fold lines on its right and left side to planar side flaps which each have a mating protuberance capable of removably mating with and coupling to the mating protuberance of the other side flaps. Each side flap has a tab disposed on an edge perpendicluar to the edge which includes the protuberance, the tabs comprising slight extensions suitable for easy handling by a finger and a thumb.

Each base is coupled to the frame by means known to the prior art such as glue. Each spacing member may be identical to each other spacing member. At least one support member is required for small frames and two spacing members are added for larger art frames. Extremely large art frames may require more than one support member or more than two spacing members. The support member is coupled to the frame so that the plane of the top member of the support member passes near the center of gravity of the frame to prevent torsional forces from being applied to the frame which could cause warping.

When one support member is used alone, as may be done on light frames, the support member should be coupled to the frame above the center of gravity of the frame sufficiently far so that in the stand off position, the slots of the side flap and the planar top member are generally aligned along the plane passing near the center of gravity of the frame. As used herein frame means the same as art, art frame, art backing, and similar words referring to items which can be hung on the wall by hangers according to the present invention.

If more than two support members are used, they should be coupled to the frame symmetrically if it is desired to have the frame hang straight, and in a selected configuration if it is desired to have the frame hang in some other manner.

Other examples within the scope of the presently described example will be obvious to those skilled in the art.

DRAWING DESCRIPTION

Reference should be made at this time to the following detailed description which should be read in conjunction with the following drawings of which:

DETAILED DESCRIPTION

Reference should be made at this time to FIGS. 1–8 which illustrate supporting and spacing or non-supporting members according to the present invention.

Figure 1:
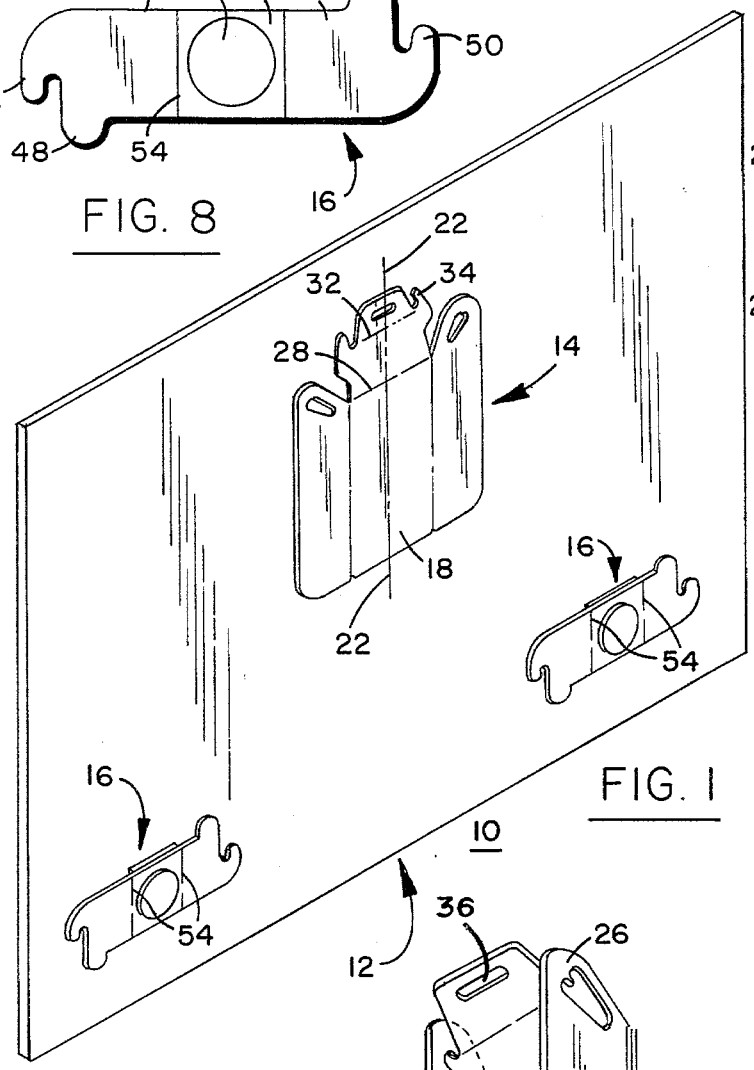
FIG. 1 is a three quarter rear view drawing of an art frame backing sheet in a first flat configuration as it would stand against the wall.
Figure 3:
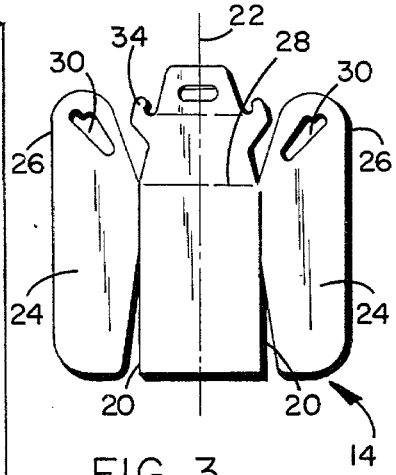
FIG. 3 illustrates a first member which supports the art and maintains the art at the desired position in relation to the wall as said member appears in the first flat configuration against a wall.
Figure 4:
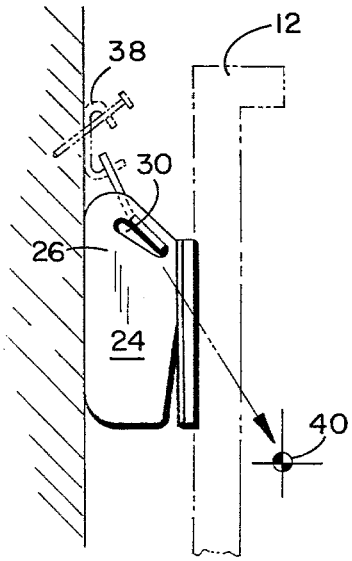
FIG. 4 is a side view of the support member of the FIG. 3 supporting an art frame in the stand-off position away from a wall.
Figure 6:
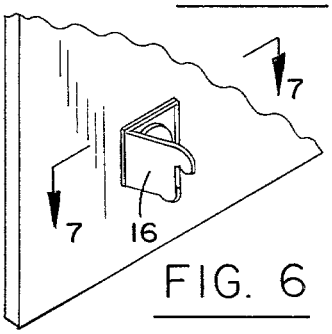
FIG. 6 is a three quarter view of a non-supporting member coupled to an art frame in the stand-off position similar to that illustrated for the supporting member in FIGS. 2 and 4.

FIG. 1 illustrates support means 10 comprising a support member 14 and two spacing members also referred to as nonsupport members 16 coupled to a frame backing 12 in a first flat configuration. The support means 10 comprises a first support and spacing member 14 hereafter referred to as the support member 14 and at least 2 spacing members 16. The support or frame 12 member 14 supports the art frame 12 also referred to as art 12 or frame 12 and maintains the top part of the art 12 at the desired position in relation to a wall. The support member 14 is axially symmetric and planar in the flat configuration and has a planar base 18 capable of being coupled to the art frame 12. The base 18 along fold lines 20 parallel to the axis 22 of the support member 14 is coupled both on its left and right sides to generally rectangular planar side flaps 24 of approximately the width that the art frame 12 is to stand off from a wall. Each side flap 24 includes a top portion 26 extending above the top fold line 28 of the base 18. Each side flap 24 is perpendicular to the base 18 (as in FIG. 2) when the art 12 is in the stand off position. When the flap 24 is perpendicular to the base 18, the top surface 26 of the flap 24 defines a slot 30. Each slot 30 defines a plane which passes very close (as shown in FIG. 4) to the center of gravity 40 of the art 12. The distance of the plane from the center of gravity 40 is a function of where the support member 14 is coupled to the art 12. The closer the plane passes to the center of gravity 40, the less torque is applied by the art frame to the support means 14.

Figure 2:
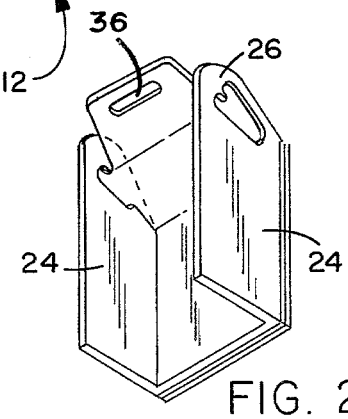
FIG. 2 is a three quarter rear view drawing of an art frame in a second stand-off position as it would stand away from the wall.

The top surface 32 also referred to as the hook 32 of the support member 14 is coupled to the base 18 along a fold line 18 which comprises the top of the base 18 and which is perpendicular to the fold lines 20 of the side flaps 24. The hook 32 has a locking tab 34 on each side. In the stand off position, each locating tab 34 removably mates with a slot 30 as shown in FIG. 2.

Figure 5:
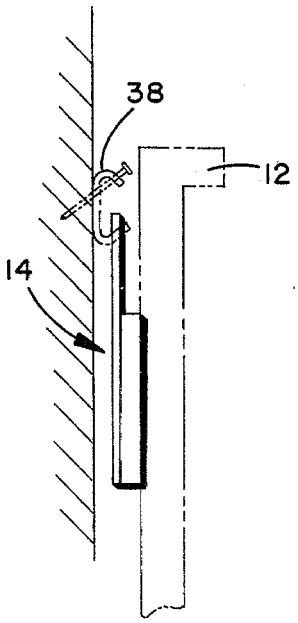
FIG. 5 is a side view of the support member of the FIG. 3 supporting an art frame in the nearly flat against the wall position where the art frame is separated from the wall only by the hanging means in its flat configuration.

The hook 32 surface defines a receptacle 36 which couples to a nail or hanging means 38 which supports the frame 12 and the support means 10. FIG. 4 illustrates a side view of the hanging of an art frame 12 in the stand off position. FIG. 5 illustrates the hanging of the same art frame in the alternate position which is substantially flush against the wall.

Figure 8:
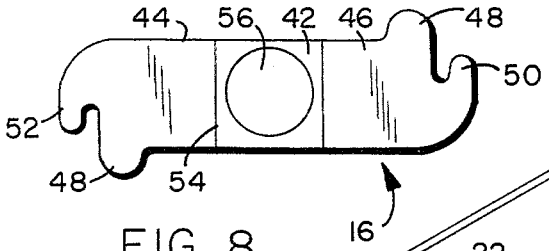
FIG. 8 illustrates one of the non-supporting members of the support means in the first flat configuration required to hold an art frame substantially against a wall.

FIG. 8 illustrates a rear view of a spacing member 16. The spacing member 16 comprises a central base 42 and 2 side flaps 44, 46. The base 42 may further include spacing means 48 which may comprise felt or any of the means known to the prior art for spacing art frames from walls.

The base 42 is coupled to the side flaps 44, 46 by parallel fold lines 54 which are generally perpendicular to the long edges on the top and bottom of the spacing member 16.

Figure 7:
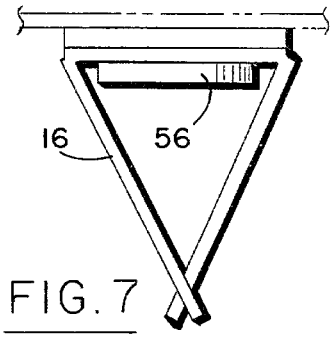
FIG. 7 is a top view of a non-supporting member in the stand-off position along the line 7—7 of FIG. 6.

The tabs 48 are of a generally convenient size and shape so that one finger and one thumb coupled to the tabs can fold the side flaps 44, 46 into the stand off position as shown in FIG. 7 or back into the flat position illustrated by FIG. 8. When the spacing member 16 is moved toward the stand off position from the flat position, a downward force exerted on the tab 48 of the flap 46 and a slight upward force exerted on the tab 48 of the flap 44 causes the mating protuberance 52 to pass over the mating protuberance 50. Release of the pressure then causes the protuberance 52 to move back down and the protuberance 50 to move back up, thereby movably locking the flaps 46 and 44 in the stand off position as illustrated by FIG. 7. Reversal of this procedure returns the spacing member 16 to the flat position as illustrated in FIG. 8.

Each base 18, 42 is coupled to the back of the frame 14 by glue or other appropriate means known to the prior art. The base 18 should be coupled so that the axis 22 points as nearly straight down as possible and is as nearly as possible adjacent a line running down through the center of gravity 40 of the frame 12. The orientation and location of the spacing members 16 are not very important, so long as they are disposed far enough from the support member 14 to form a triangle relatively large in area compared to the area of the frame 12. For very large frames 12, more than one support member 14 and more than two spacing members 16 may be utilized for greater stability. If two support members 14 are utilized, they should be coupled to the frame 12 equal distances to the right and left of the center of gravity 40 and at the same level so that the frame hangs straight. If one support means 14 is utilized, and it is desired to have the frame 12 hang in a manner which is not straight, the support means 14 should be displaced to the side which is desired to be higher a distance proportional to the amount of slant desired. By varying the width of the flaps 24, 44, 46, it is possible to cause the art to reversably stand off from the wall in a selected orientation not parallel to the wall. If it is desired to have the frame 12 stand off parallel to the wall, the flaps 44, 46 must be slightly longer than the flaps 24, because in the stand off position, the flaps 24 are perpendicular to the wall, while the flaps 44, 46 form a generally triangular cross section as illustrated in FIG. 7. The relative widths of the flaps is determined by well known principals of trijonometry for various stand off distances.

A particular example of the invention has been described as required by patent law. Those skilled in the art will understand that there are many other possible examples of the invention within the equivalent of the preceeding description. The scope of the invention is limited only by the following claims.

I claim:

1. An at least one member, reversible, two position support and spacing means capable of coupling to and holding an art frame in a first, flat configuration substantially against a wall, and in a second, stand off position a selected distance away from the wall is presented, comprising:

a first, generally axially symmetric, support and spacing member comprising a planar base capable of being coupled to the frame, the base having coupled thereof on each the left and right side along fold lines generally parallel to the axis generally rectangular, planar side flaps about the width that the frame is to stand off from the wall in the stand off position, each side flap including a top surface above the top of the base defining a slot which slot when the side flap is perpendicular to the base is generally aligned along the plane passing near the center of gravity of the art frame;

the top surface of the base is coupled along a fold line perpendicular to the axis to a planar top member having a locking tab on each side flap when the side flaps are folded perpendicular to the base, the plane of the top member passing near the center of gravity of the frame when the tabs are mated to the slots, the surface of the planar top member defining a receptacle capable of mating with hanging means coupled to a wall, the side flaps are capable of rotating slightly in relation to the base; the surface of the base is coupled to each side flap along a fold line which extends only along the apporximate middle third of the height of each side flap, thereby permitting each side flap to rotate slightly in relation to the base to compensate for structural changes in the art after hanging; and means to couple the base to the art frame.

2. The invention of claim 1, further including at least two spacing members, each spacing member comprising a planar generally rectangular base coupled along parallel fold lines along opposite edges of the base to planar side flaps which each have a mating protuberance capable of removeably mating with and coupling to the mating protuberance of the other side flap, the distance from the base to the farthest edge of a mating protuberance when the mating protuberances are coupled together being approximately the width of a side flap of the support and spacing member.

3. The invention of claim 2, wherein each side flap has a tab disposed on an edge perpendicular to the edge which includes the protuberance and opposite to the tab of the opposite side flap, the tabs comprising slight extensions suitable for easy handling by a finger.

* * * * *